US006390881B1

(12) United States Patent
Yu et al.

(10) Patent No.: US 6,390,881 B1
(45) Date of Patent: May 21, 2002

(54) WATER DANCE CONDUCTOR TOY

(76) Inventors: Hui-Nan Yu; Tzu-Hen Tong; Chi-Feng Chung, all of 14, Lane 252, Chien Kuo Road, Taoyuan (TW)

( * ) Notice: Subject to any disclaimer, the term of this patent is extended or adjusted under 35 U.S.C. 154(b) by 0 days.

(21) Appl. No.: 09/814,748

(22) Filed: Mar. 23, 2001

(51) Int. Cl.[7] ..... A63J 19/00

(52) U.S. Cl. ..... 446/83; 446/298; 446/397; 40/414

(58) Field of Search ..... 446/82, 83, 84, 446/175, 219, 297, 298, 330, 359, 408, 397; 40/414

(56) References Cited

U.S. PATENT DOCUMENTS 1,777,712 A * 10/1930 Barnum ..... 446/297

4,804,348 A * 2/1989 Bondi ..... 446/83

* cited by examiner

*Primary Examiner*—Jacob K. Ackun
(74) *Attorney, Agent, or Firm*—Troxell Law Office PLLC

(57) ABSTRACT

A water dance conductor toy comprising a stage holding an electronic control device on the inside, a rotary conductor's podium supported on a holder frame pivoted to the stage and controlled by the electronic control device to rotate clockwise/counter-clockwise through 180°, a conductor supported on the rotary conductor's podium and controlled by the electronic control device to bow, and a water dance unit mounted on the stage, the water dance unit including an elongated base pivoted to the stage, a plurality of lamp bulbs mounted in the elongated base and controlled by the electronic control device to flash, and a plurality of stick-like light guide elements mounted on the elongated base and adapted to guide out light from the lamp bulbs to produce a lighting effect.

5 Claims, 6 Drawing Sheets

WATER DANCE CONDUCTOR TOY

BACKGROUND OF THE INVENTION

The present invention relates to toys and, more particularly, to a water dance conductor toy.

Following fast development of high technology, a variety of electronic control devices are disclosed for use to control the motion of toys.

SUMMARY OF THE INVENTION

According to one aspect of the present invention, the water dance conductor toy comprises a stage, a water dance unit and a rotary conductor respectively mounted on the stage, and an electronic control device mounted inside the stage and adapted to rotate and bow the conductor and to control the water dance unit to produce a lighting effect through light guide elements, simulating the performance of water dance. According to another aspect of the present invention, the conductor and the water dance unit can be collapsed and received in a stop recess of the stage when not in use. According to still another aspect of the present invention, the stage comprises a plurality of stationery troughs for keeping writing materials, and a plurality of penholders for keeping pens, pencils, and the like.

DETAILED DESCRIPTION OF THE PREFERRED EMBODIMENT

Figure 1:
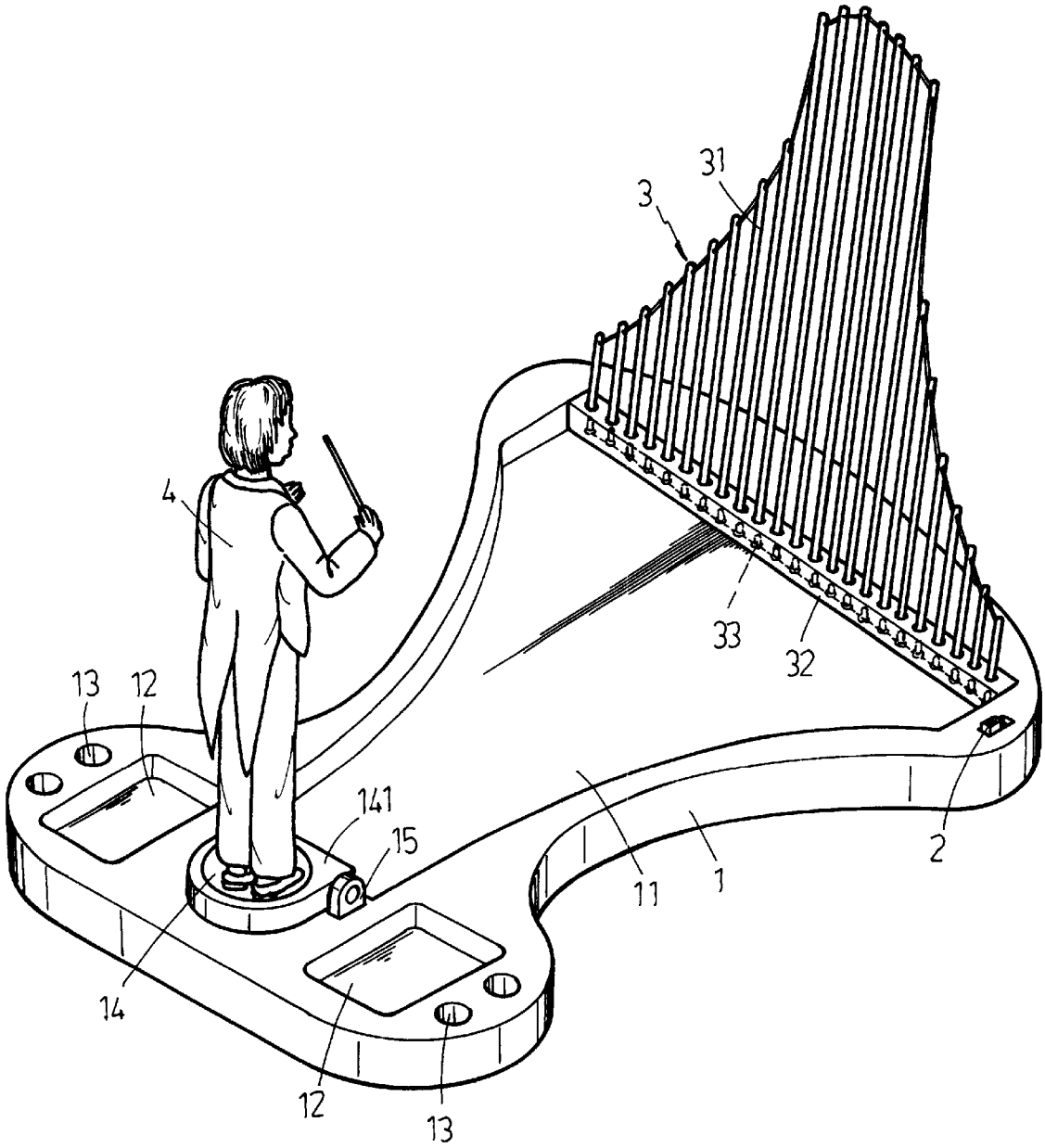
FIG. 1 is a perspective view of a water dance conductor toy according to the present invention.
Figure 2:
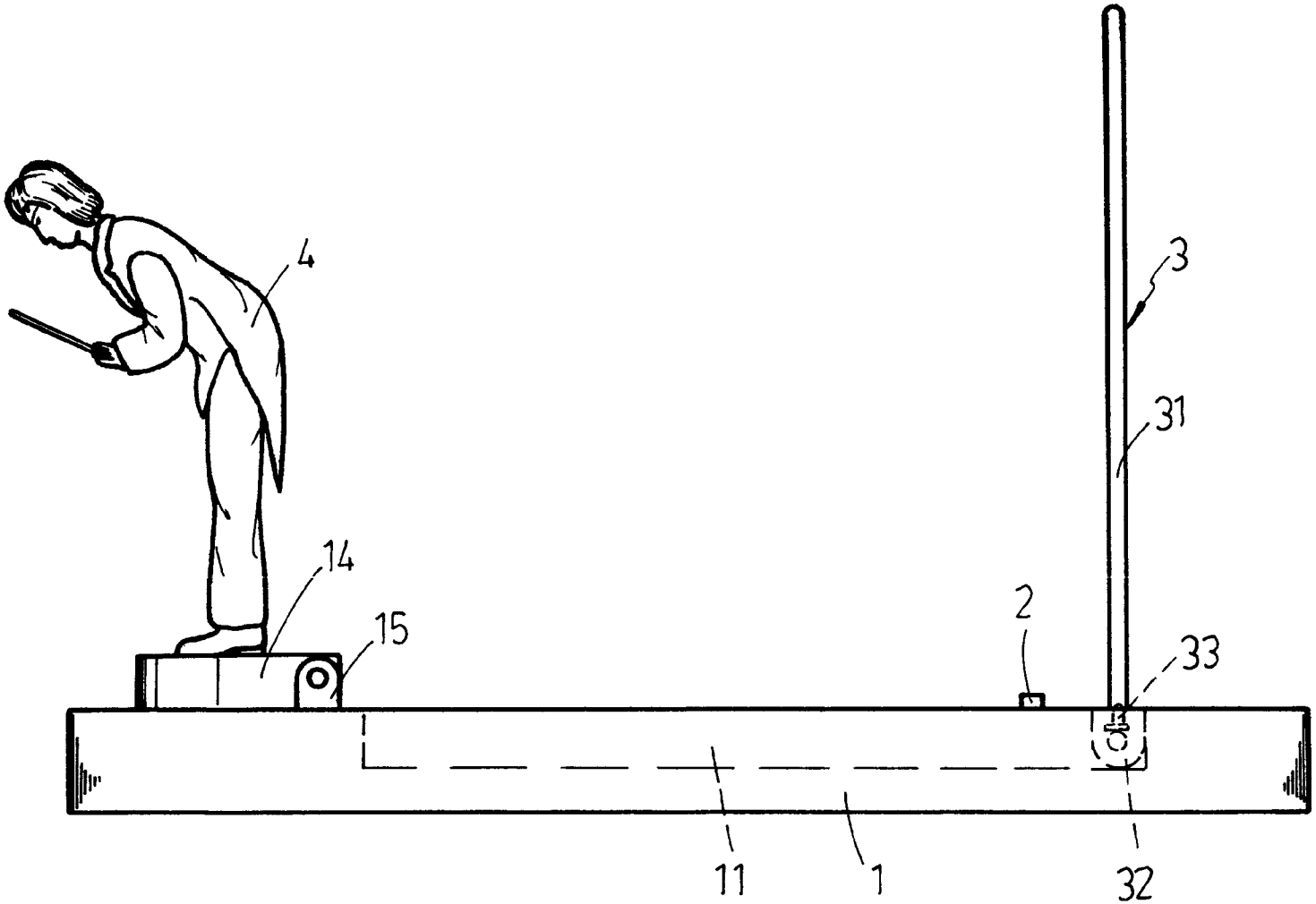
FIG. 2 shows an action of the performance of the water dance conductor toy according to the present invention.
Figure 3:
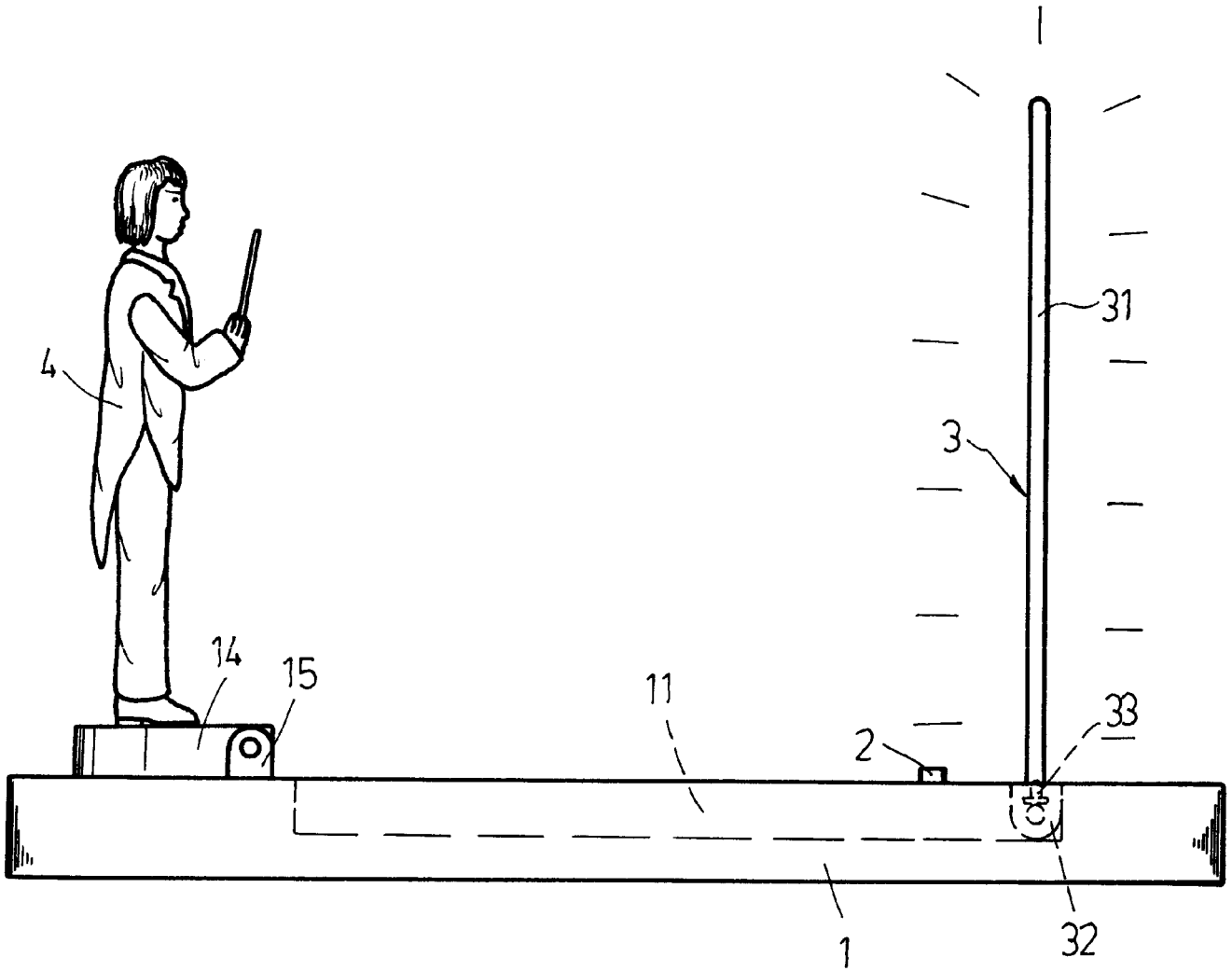
FIG. 3 shows another action of the performance of the water dance conductor toy according to the present invention.

Referring to FIG. 1, a water dance conductor toy is shown comprised of a stage 1, an electronic control circuit board (not shown) installed in the stage 1, a water dance unit 3 mounted on the stage 1 near one side, an a conductor 4 disposed at the top side of the stage 1 remote from the water dance unit 3, and an on/off switch 2 provided near one side of the stage 1 for on/off control. The stage 1 comprises a top recess 11, two upright lugs 15 arranged in parallel near one side, a holder frame 141 pivoted to the upright lugs 15, a rotary conductor's podium 14 mounted in the holder frame 141, a plurality of recessed stationery troughs 12, and a plurality of penholders 13. The conductor 4 is mounted on the rotary conductor's podium 14. The water dance unit 3 comprises an elongated base 32 pivoted to the stage 1 at one side of the top recess 11, a plurality of lamp bulbs 33 mounted in the elongated base 32 and arranged in a line along the length of the elongated base 32, and a plurality of stick-like light guide elements 31 fastened to the elongated base 32 and aimed at the lamp bulbs 33 respectively. The stick-like light guide elements 31 have different lengths, and are arranged to show a particular design. The stick-like light guide elements 31 guide out light from the lamp bulbs 33 to produce a lighting effect simulating the real water dance.

Referring to FIGS. from 1 through 3, when turning on the on/off switch 2, the electronic control circuit board drives a transmission mechanism (not shown) to rotate the rotary conductor's podium 14 in one direction through 180° and to bow the conductor 4, simulating the performance of conducting a concert, and then drives the transmission mechanism to rotate the rotary conductor's podium 14 in the reversed direction through 180° and to return the conductor 4 to its former upright position, and then drives a music IC (not shown) to output tones through a speaker (not shown) and simultaneously selectively turns on/off the lamp bulbs 33 to produce a lighting effect.

Figure 4:
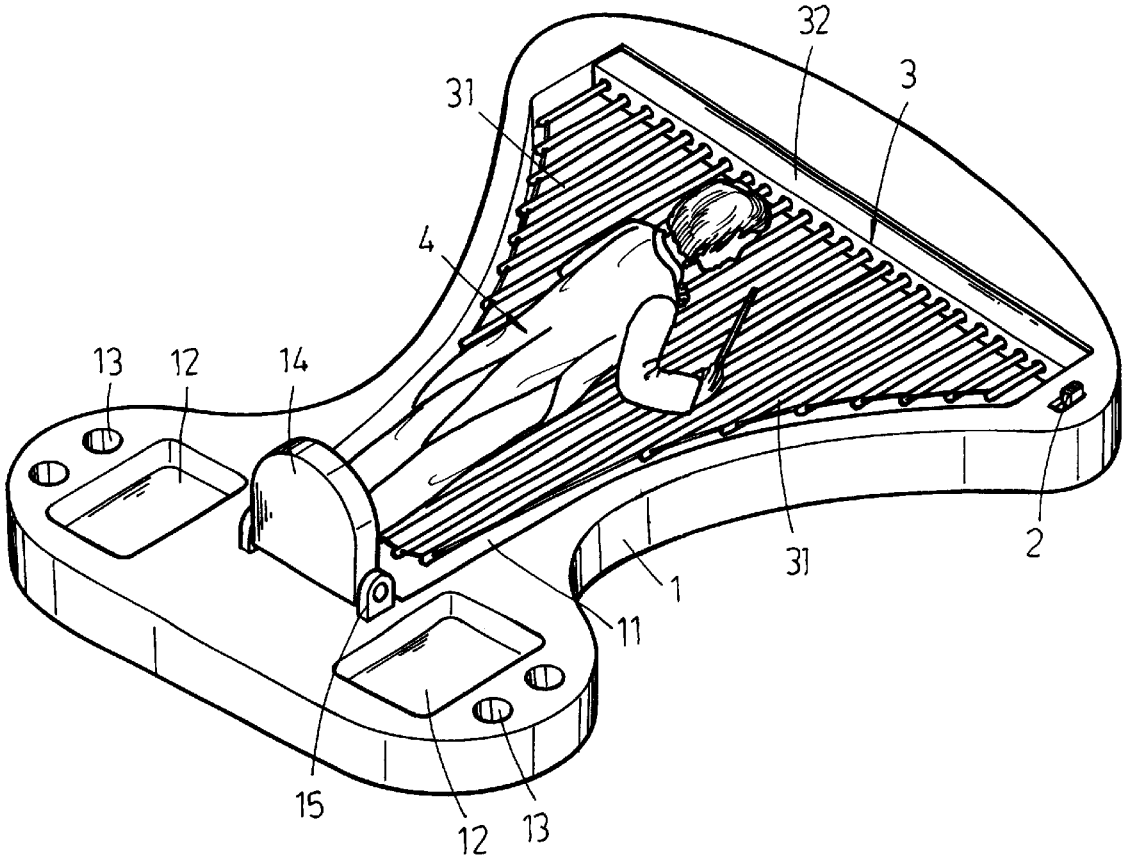
FIG. 4 is an oblique top view of the present invention showing the water dance conductor toy collapsed.
Figure 5:
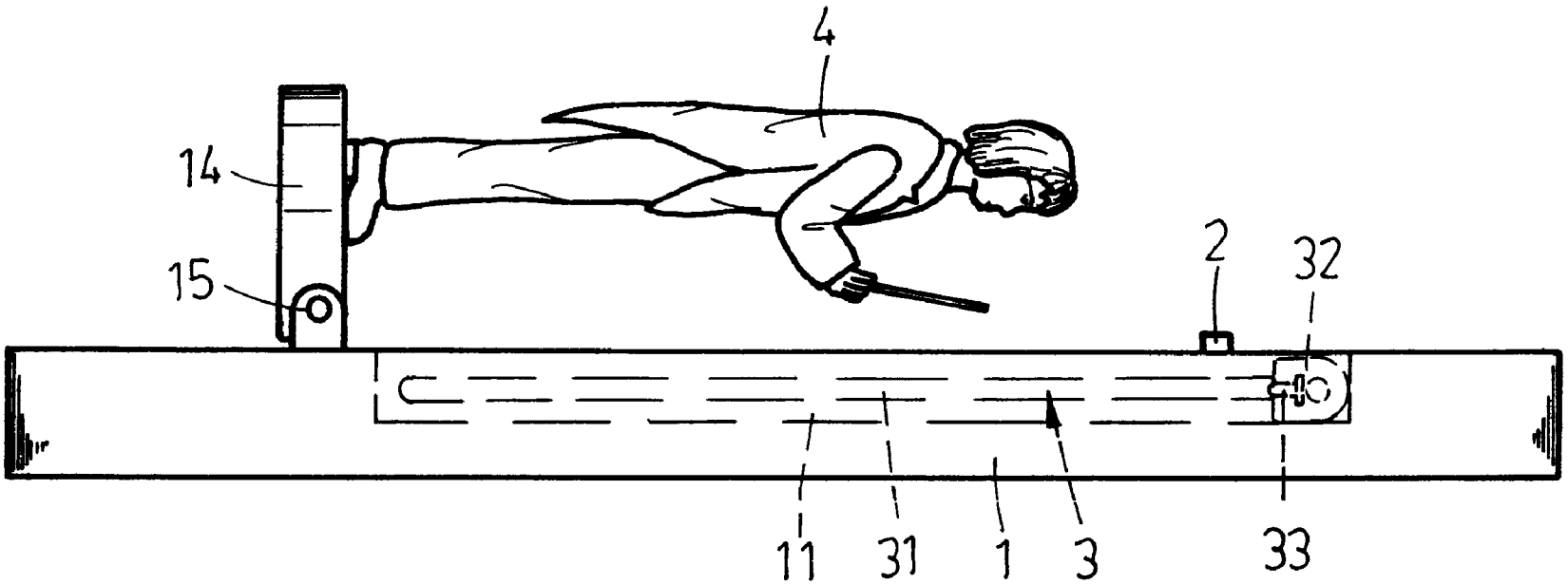
FIG. 5 is a side view of FIG. 4.

Referring to FIGS. 4 and 5, when not in use, the water dance device 3 is turned downwards and closely attached to the top surface of the top recess 11 of the stage 1, and then the conductor 4 is turned with the rotary conductor's podium 14 and the holder frame 141 in one direction and suspended above the collapsed water dance unit 3. When collapsed, the holder frame 14 is disposed in vertical, holding the conductor 4 in a horizontal position above the water dance unit 3 without touching the water dance unit 3.

Figure 6:
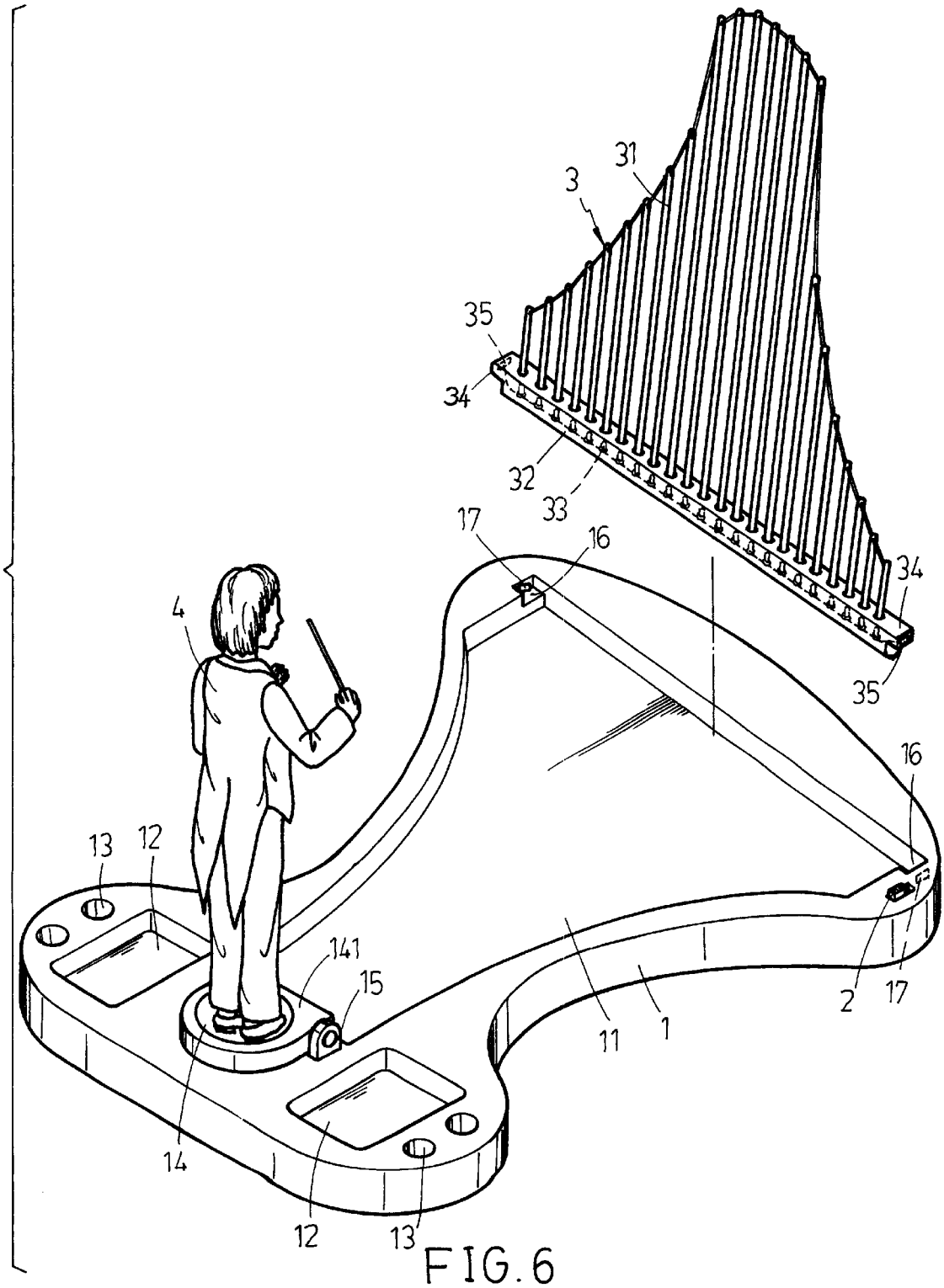
FIG. 6 shows an alternate form of the present invention.

FIG. 6 shows an alternate form of the present invention. According to this alternate form, the elongated base 32 of the water dance unit 3 has two protruded ends 34, and two metal contact plates 35 respectively mounted on the protruded ends 34. The top recess 11 of the stage 1 comprises two coupling holes 16 adapted to receive the protruded ends 34 of the elongated base 32 of the water dance unit 3, and two metal contact plates 17 respectively mounted in the coupling holes 16 and connected to power source. The water dance unit 3 and the stage 1 are separately packed. When in use, the water dance unit 3 is installed in the stage 1, keeping the metal contact plates 35 of the water dance unit 3 maintained in contact with the metal contact plates 17 of the stage 1 to guide electricity to the lamp bulbs 33.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A water dance conductor toy comprising a stage holding an electronic control device on the inside, said stage comprising a top recess, a rotary conductor's podium mounted on said stage and controlled by said electronic control device to rotate clockwise/counter-clockwise through 180°, a conductor supported on said rotary conductor's podium and controlled by said electronic control device to bow, and a water dance unit mounted in said top recess at one side remote from said rotary conductor's podium, said water dance unit comprising an elongated base pivoted to said stage, a plurality of lamp bulbs mounted in said elongated base and controlled by said electronic control device to flash, and a plurality of stick-like light guide elements mounted on said elongated base and respectively aimed at said lamp bulbs and adapted to guide out light from said lamp bulbs to produce a lighting effect.

2. The water dance conductor toy of claim 1 wherein said rotary conductor's podium can be turned relative to said stage to hold said conductor between a first position perpendicular to said stage and a second position in parallel to said stage.

3. The water dance conductor toy of claim 1 wherein said stage comprises two upright lugs, a holder frame holding said conductor and pivoted to said upright lugs.

4. The water dance conductor toy of claim 1 wherein said stage comprises a plurality of stationery troughs and pen-holders.

5. The water dance conductor toy of claim 1 wherein said stage comprises two coupling holes bilaterally disposed in said top recess remote from said rotary conductor's podium, and two metal contact plates respectively mounted in said coupling holes and connected to power supply; the elongated base of said water dance unit comprises two protruded ends respectively coupled to the coupling holes of said stage, and two metal contact plates respectively mounted on said protruded ends and disposed in contact with the metal contact plates of said stage and adapted to guide electricity to said lamp bulbs.

* * * * *